United States Patent [19]

Oba

[11] Patent Number: 4,782,200

[45] Date of Patent: Nov. 1, 1988

[54] SWITCH ASSEMBLY

[75] Inventor: Hiroki Oba, Furukawa, Japan

[73] Assignee: Alps Electric Co., Ltd., Japan

[21] Appl. No.: 900,504

[22] Filed: Aug. 26, 1986

[30] Foreign Application Priority Data

Aug. 30, 1985 [JP] Japan ..... 60-131729[U]

[51] Int. Cl.[4] ..... H01H 9/02; H01H 15/00

[52] U.S. Cl. ..... 200/16 A; 200/303

[58] Field of Search ..... 200/6 R, 6 B–6 BB, 200/61.62, 61.76–61.82, 159 R, 159 A, 303, 330, , 332, 335, 338, 339, 153 H

[56] References Cited

U.S. PATENT DOCUMENTS 3,944,766 3/1976 Wood ..... 200/159 R X 4,488,018 12/1984 Hayashida ..... 200/276 X 4,514,603 4/1985 Staples ..... 200/61.62

*Primary Examiner*—J. R. Scott

*Attorney, Agent, or Firm*—Guy W. Shoup

[57] ABSTRACT

A switch assembly includes a wafer defining a cavity, a case defining a guide hole and received in the cavity, and a slide reciprocally movably received in the guide hole to close or open contacts provided in the cavity. The case and slide are originally molded in a single body united by runners and they are separated by cutting the runners just before the case is mounted on the wafer, but the slide is held in the guide hole and never drops from it before the case is mounted in position of the wafer.

4 Claims, 9 Drawing Sheets

SWITCH ASSEMBLY

FIELD OF THE INVENTION

This invention relates to a switch assembly configured to effect switching operation by compressing a slide in the length direction, and more particularly to a significantly small-scaled switch assembly mainly used in switching operation responsive to movement of a member in a system.

BACKGROUND OF THE INVENTION

A prior art switch assembly of this type comprises a case and a slider which are formed in separate bodies and coupled together by inserting the slider in a guide hole of the case. The coupled body is mounted on a wafer prepared separately. One example of this assembly is shown in FIGS. 12 through 16. FIG. 12 is a side elevation of the prior art switch assembly which generally comprises a wafer 3 having a pair of downward projecting terminals 1 and 2, a case 4 provided on the wafer 3, and a slide 6 received in a guide hole 5 of the case 4.

The terminal 1 is electrically connected to a contact 7 in the form of a coil spring, and the terminal 2 is electrically connected to a contact 8 in the form of a clip at the other side. One end of the slide 6 is snappingly pushed upward in FIG. 13 and contacts a contact portion 7*a* of the coil spring contact 7. The other end of the slide 6 passes through the guide hole of guide member 5*a* formed on the case 4 reciprocally up and down in FIG. 13. On the other hand, a mount portion 4*a* of the case 4 for engagement with the wafer 3 is provided at both ends thereof with engage recesses 4*b*-4*b* engageable with engage projections 3*a*-3*a* formed on both lengthwise end surfaces of the wafer so that the case 4 is inseparably held on the wafer 3 due to the resiliency of the case itself unless it is removed by intention.

On manufacturing the switch assembly, a base board 9 having terminals 1 and 2 is punched out from a metal plate in the form of a hoop and having a good conductivity. Thereafter, as shown in FIG. 15, a receptor plate 10 made of a metal conductor is provided on the terminal 1 to support the coil spring contact 7 for reliable contact therebetween, and the aforegoing clip-shaped contact 8 is provided on the terminal 2. The hoop material is transported according to a predetermined manufacturing process to make the box-shaped wafer 3 which includes the receptor plate 10 and contact 8 in central positions as shown in FIG. 16. The contact 7 is mounted on the receptor plate 10 with a coil portion 7*c* of the contact 7 contacting therewith. The slide 6 is inserted in the guide hole 5 of the case 4 upwardly in FIG. 16, and the case 4 receiving the slide 6 therein is applied to the wafer 3 downwardly, resiliently engaging the engage projections 3*a*-3*a* with the engage recesses 4*b*-4*b*. The coil spring contact 7 is supported by a contact stopper 4*d* extending downward from an upper plate 4*e* of the case 4, and the contact end 7*b* is loosely received in a guide slit 4*c*. Reference numeral 4*f* (FIGS. 13 and 14) denotes a mount hole to fix the assembly to a panel or other support member.

In the switch assembly, when the contact end 7*b* of the contact 7 abuts the lower surface of a push portion 6*a* at the lower end of the slide 6 and pushes the slide 6 in the A direction in FIG. 13, the contact portion 7*a* moves by an amount equal to the movement amount of the slide 6 up to a stopper 3*b* at the bottom of the wafer

3. At that time, still referring to FIG. 13, the contact end 7*b* of the contact 7 located at a position substantially parallel to the push portion 6*a* of the slide 6 is contactingly sandwiched by a clip-shaped slidable portion 8*a* of the contact 8 which is electrically connected to the terminal 2, and the contact portion 7*a* slidably moves until it abuts the stopper 3*b* and closes the circuit. When compression is removed from the slide 6, the contact portion 7*a* is rotated in the B direction in FIG. 14 by the resiliency of the coil portion 7*c* of the contact 7, pushing the slide 6 in the C direction. When the contact portion 7*a* returns to its original position, pushing back the slide 6, the contact end 7*b* moves apart from the slidable portion 8*a* of the contact 8 and opens the circuit.

The switch assembly is usually mounted adjacent a movable member of a system and configured to activate the slide 6 in response to movement of the movable member, so as to detect the position of the movable member or establish an expected operation subsequent to movement of the movable member.

In such a use of the switch assembly, the slide 6 is mounted engageably with the movable member. Therefore, the assembly must be significantly small-scaled to never disturb movement or placement of other members of the system. This means that individual parts or members of the assembly are extremely small and make it difficult to couple or assemble them. Among these parts or members, the slide 6 particularly invites a trouble that it is apt to drop before the case 4 is brought in position of the wafer, because the slide 6 is inserted in the case 4 from the bottom, and the case 4 is coupled on the wafer, facing the bottom downward.

OBJECT OF THE INVENTION

It is therefore an object of the invention to provide a small-scaled switch assembly including a slide which is molded in a single body with a case, hence readily assembled, and never inferior to the prior art assembly in switching function.

SUMMARY OF THE INVENTION

In accordance with the present invention, there is provided a switch assembly including a first contact electrically connected to a first terminal, a second contact in the form of a coil spring and electrically connected to a second terminal, a wafer containing said both contacts, a case mounted at an opening of said wafer, and a slide received in a guide hole of said case and slidably reciprocated therein to connect or disconnect said contacts in said case, and characterized in that said case and slide are originally formed in a single body united together by runners and thereafter separated by cutting the runner, and that relief slits are selectively provided along the inner surfaces of the guide hole of the case and along the outer surfaces of the slide to avoid or alleviate hitting or dragging against the projecting runners against opposed surfaces, so as to prevent a jam or malfunction caused by awkward reciprocation of the slide. The case and slide are formed and maintained in a single body before the runners are cut, and the slide is prevented from dropping. The runners are cut just before the case is coupled to the wafer. Therefore, the assembling process is significantly improved. Further since the runner projections which remain at positions after separation can move in relief slots offset from surfaces opposed to the projections, the switch assembly is protected against possible jam or malfunction caused by the projections hitting or dragging against the opposed surfaces.

BRIEF DESCRIPTION OF THE DRAWINGS

FIGS. 1 through 6 illustrate a first embodiment of the invention switch assembly in which:

FIG. 1 is a side elevation of a case of the assembly;

FIG. 2 is a plan view of the case of FIG. 1;

FIG. 3 is a side elevation of the case of FIG. 1 from which a slide is separated;

FIG. 4 is a perspective view illustrating how to couple the case on a wafer;

FIG. 5 is a fragmentary plan view of a guide hole of the case of FIG. 1; and FIG. 6 is a side elevation of the entire switch assembly including the case and wafer coupled together.

FIGS. 7 through 11 illustrate a second embodiment of the invention in which:

FIG. 7 is a side elevation of a case of the assembly;

FIG. 8 is a side elevation of the case of FIG. 7 with a lever bent back;

FIG. 9 is a side elevation of the entire switch assembly;

FIG. 10 is a plan view of the switch assembly with the lever extending straight; and FIG. 11 is a plan view of the switch assembly with the lever bent back.

FIGS. 12 through 16 illustrate a prior art switch assembly in which:

FIG. 12 is a side elevation of the entire switch assembly;

FIG. 13 is a partly cross-sectioned side elevation of the assembly in the off (initial) state;

FIG. 14 is a partly cross-sectioned side elevation of the assembly in the on (full stroke) state;

FIG. 15 is a perspective view illustrating how to provide a hoop-shaped base board with contacts; and FIG. 16 is a perspective view illustrating how to couple the case on a wafer.

DETAILED DESCRIPTION

Figure 1:
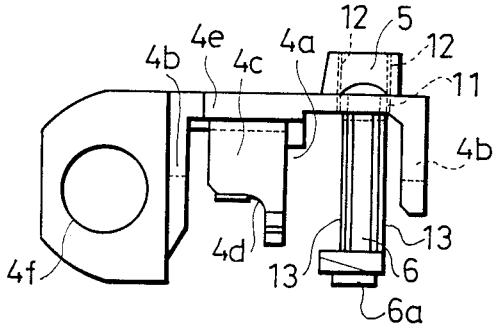

The invention is hereinbelow described in detail, referring to some embodiments illustrated in the drawings.

FIGS. 1 through 6 show a first embodiment of the switch assembly according to the invention. Some members or parts equal or equivalent to those in the prior art switch assembly are designated by the same reference numerals.

Figure 2:
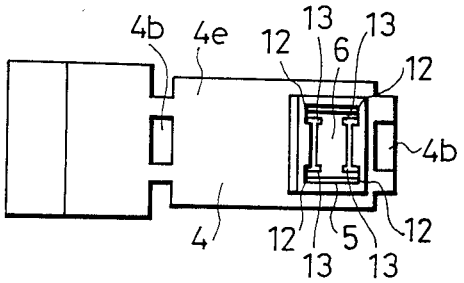
Figure 5:
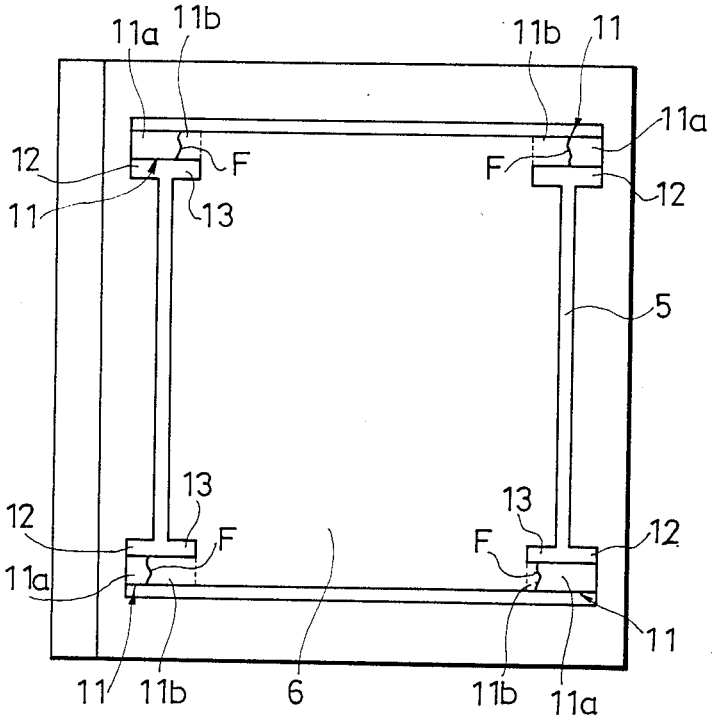
Figure 6:
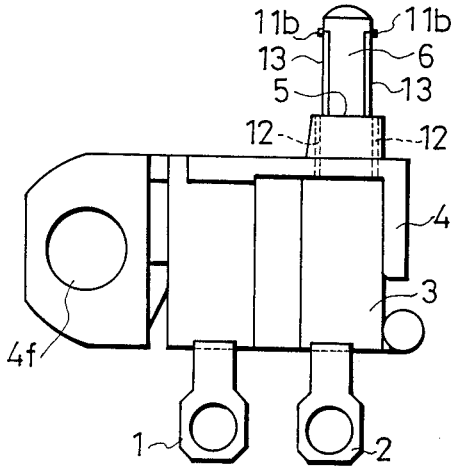

In FIGS. 1 and 2, a case 4 has a mount portion 4*a* for coupling engagement with a wafer 3 and engage recesses 4*b*-4*b* for engagement with engage projections 3*b*-3*b* of the wafer 3. The mount portion 4*a* includes a contact retaining projection 4*d* which downwardly extends from an upper plate 4*e* and defines a guide hole 4*c* for guiding a contact end 7*b* of a contact 7. The upper plate 4*e* has a guide hole 5 for movably receiving a slide 6. The slide 6 is originally located in the guide hole 5 and immovably fixed to the lower end of the guide hole 5 by runners 11-11 so as to form a single molded body of a plastic resin with the case 4. The guide hole 5 is provided along the inner surface thereof above the runners 11-11 with relief slits 12 extending in the movement direction of the slide 6. On the other hand, the slide 6 is provided along the outer surfaces thereof below the runners 11-11 with relief slits 13 extending in the length direction (sliding direction) of the slide 6. These relief slits 12 and 13, as best shown in FIGS. 2 and 5, are provided in four corners of the slide 6 and of the guide hole 5 respectively, corresponding to positions of the runners 11-11 provided at four corners of them. The guide hole 5 is also provided with a projection 5for limiting the slidable movement of the slide 6 so as to provide a constant position of the distal end of the slide 6 for contact with a member to be associated or cooperate with the slide 6.

Figure 3:
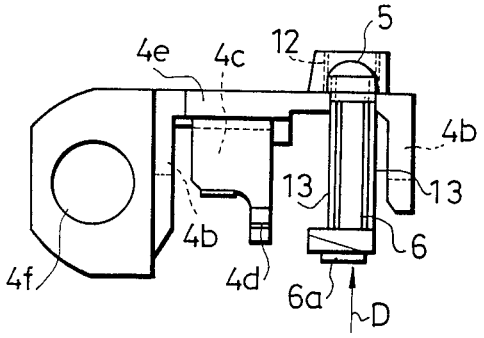
Figure 4:
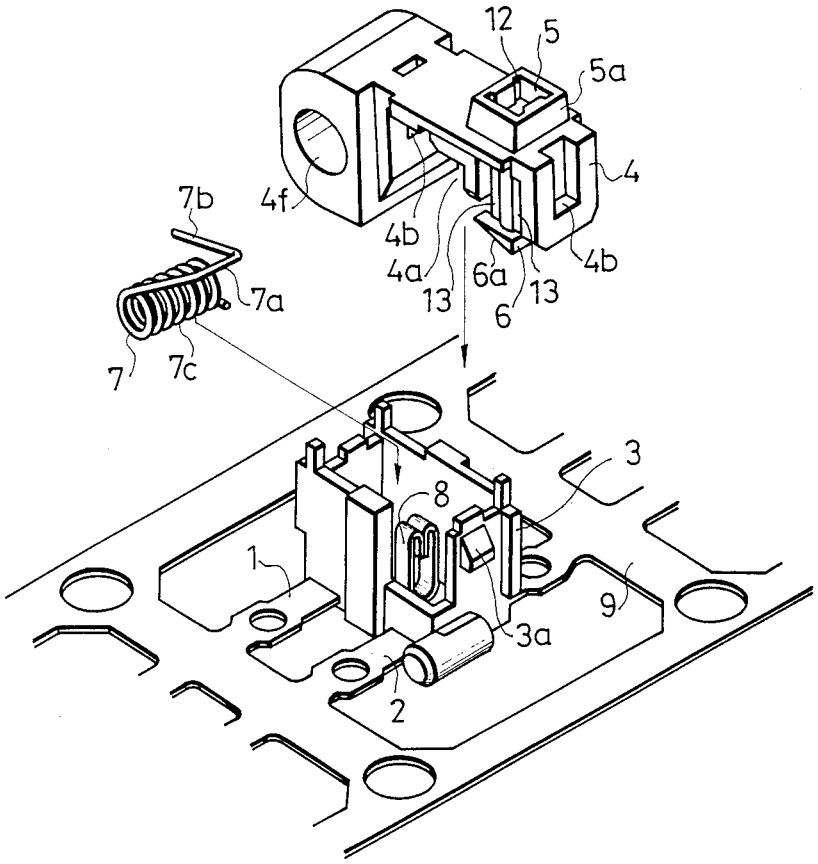

The slide 6, which is originally united to the case 4 by the runners 11-11 as shown in FIGS. 1 and 2, is being detached from the case 4 by applying an upward force (in the D direction in FIG. 3) to the slide 6 and cutting the runners 11-11 at positions F as shown in FIG. 5. The slide 6, after being detached, takes an upper position than the position of FIG. 1 before separation. After the runners 11-11 are cut, they remain at positions of the guide hole 5 and slide 6 and form runner projections ll*a*-ll*a* and ll*b*-ll*b*. The runner projections ll*b*-ll*b* extending from the slide 6 slightly contact the upper end corners of runner projections ll*a*-ll*a* extending from the guide hole 5, and hold the slide 6 movably in the guide hole 5 as shown in FIG. 3. The case 4 supporting therein the slide 6 is coupled to the wafer 3 which is already provided with contacts 7 and 8, by inserting the mount portion 4*a* of the case 4 in the cavity of the wafer 3 from the upper end thereof and engaging the engage recesses 4*b*-4*b* of the case 4 with the engage projections 3*a*-3*a* of the wafer 3. As to the other members equal or equivalent to those in the prior art assembly, redundant explanation is omitted here.

In practically assembling the switch assembly including the single molded body of the slide 6 and case 4 as described before, the wafer 3 is prepared by providing the contact 8 and receptor 3*b* on the base board 9 which is still in the form of a hoop. Thereafter, the coil spring contact 7 is mounted in the receptor 3*b*. Just before the case 4 is mounted on the wafer 3, the slide 6 is pushed in the D direction to cut the runner 11-11, and the case 4 holding the slide 6 in the guide hole 5 is thereafter mounted on the wafer 3. Finally, the base board 9 is separated from the hoop by cutting the terminals 1 and 2, and a finished switch assembly is obtained. In this process, before the case 4 is mounted on the wafer 3, there is a step of cutting the runners 11-11 by pushing the slide 6 in the D direction. This step, however, may be omitted if the runners 11-11 have a modest strength to be cut by a force in the D direction which is applied to the slide 7 when the case 4 is forcibly pushed to the wafer 3 because the slide 6 downwardly projects from the bottom of the case 4.

This arrangement eliminates the use of a specific tool for cutting the runners 11-11. Further, the slide 6 is held in the guide hole 5 after being detached, and never drops while the case 4 is coupled to the wafer 3. The runners 11-11 are cut at unfixed, different positions. Therefore, if the outer surfaces of the slide 6 and the inner surfaces of the guide hole 5 are uniformly flat respectively, there is a possibility that the outer margins of the runner projections after separation hit of drag against opposed surfaces and disturb the reciprocal movement of the slide 6. However, in the described embodiment of the invention, the surfaces are provided with the relief slits 12 and 13 which are offset away from the runner projections to avoid contact therebetween. If the relief slits 12 and 13 are not so deep and permit one or some of the runner projections extremely long to contact them, a large contact force which may cause a malfunction is never produced because the most part of the runner projections do not contact the opposed surfaces.

Referring to FIGS. 7 through 11, a further embodiment of the invention is hereinbelow described. Some parts or members in this embodiment which are equal or equivalent to those in the prior art or in the aforegoing embodiment are designated by the same reference numerals.

Figure 7:
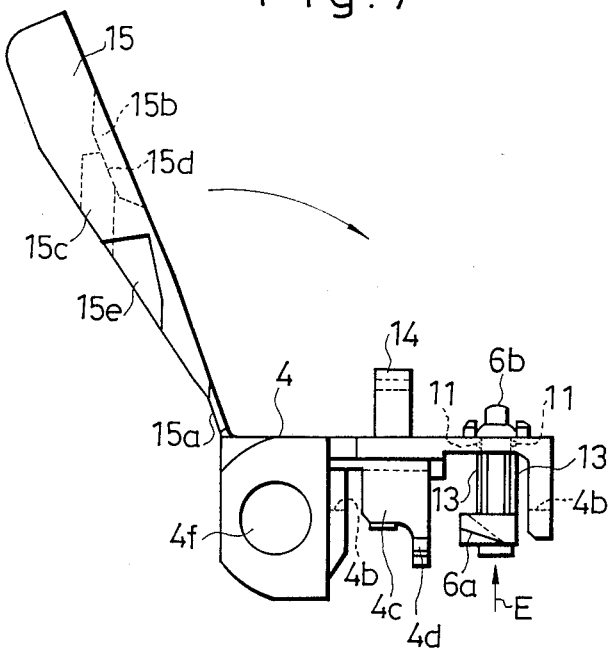
Figure 8:
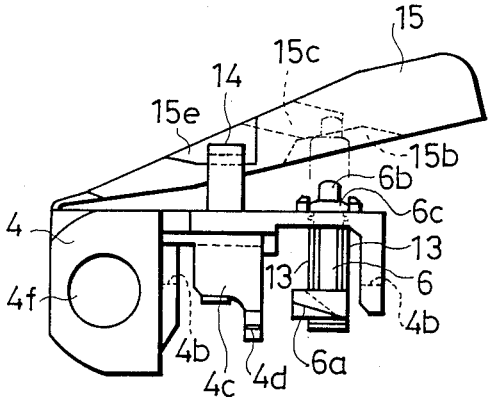

FIG. 7 is a side elevation of the case 4 having a resilient lever 15 which extends from an upper edge of the case 4 remote from the slide 6. The lever 15, slide 6 and case 4 are formed in a single molded body of a plastic resin. The slide 6 is united to the case 4 by the four runners 11-11 as in the first embodiment, and the lever 15 is united to the case 4 by a hinge 15*a*. The lever 15 is provided with a recess 15*b* which is engageable with the top end 6*b* and the shoulder 6*c* of the slide 6 to fix the position of the slide 6. The lever 15 is also provided with a through hole 15*c* extending from the recess 15*b* to the opposite surface of the lever 15 for accepting the top end of the slide 6 in a boundary 15*d* between the recess 15*b* and through hole 15*c* when the lever is bent on the slide 6 (shown by a slash-and-dotted line in FIG. 8). The through hole 15*c* is provided to facilitate removal of a mold, and serves to properly fix the position of the top end of the slide 6. Further, the lever 15 is provided with engage depression 15*e*-15*e* at both lateral surfaces to accept engage projections 14 projecting from the upper surface of the case 4 and limit the movement of the lever 15 when the lever 15 is bent on the case 4.

Figure 9:
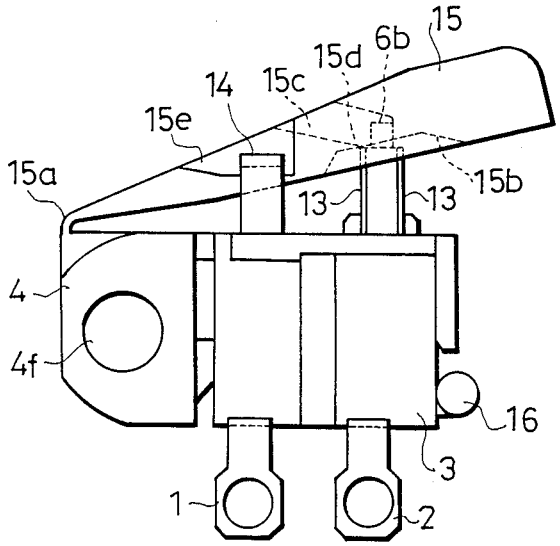
Figure 10:
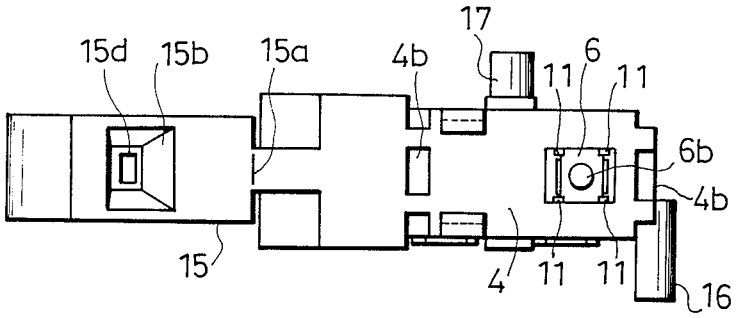
Figure 11:
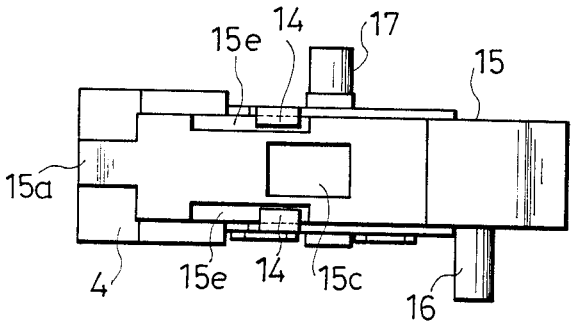
Figure 12:
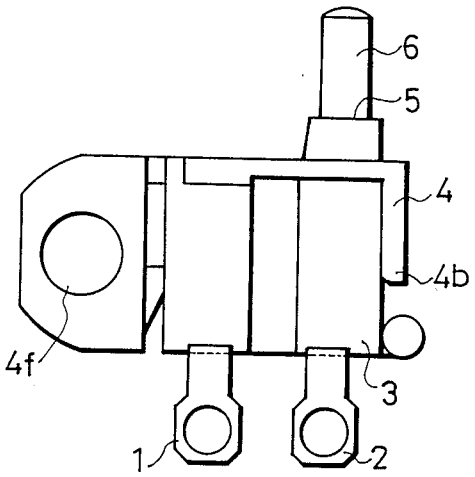
Fig. 12 PRIOR ART
Figure 13:
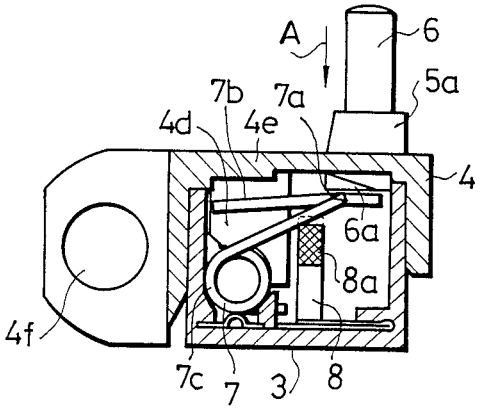
Fig. 13 PRIOR ART
Figure 14:
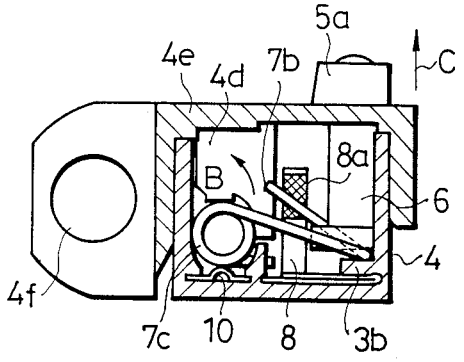
Fig.14 PRIOR ART
Figure 15:
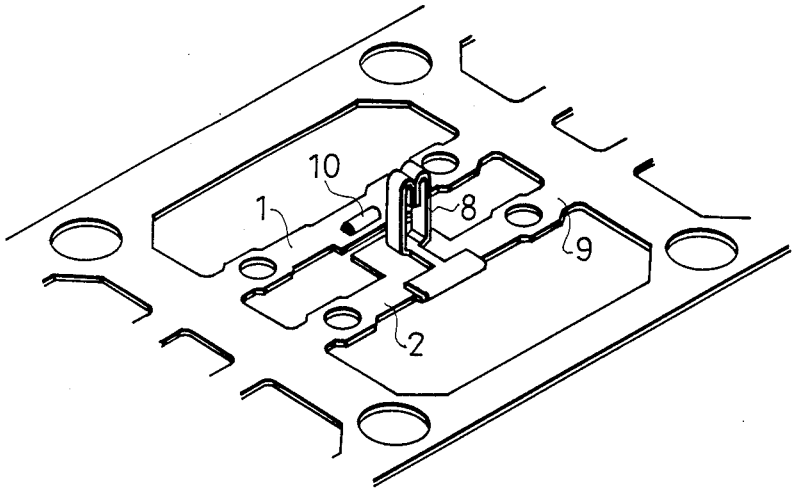
Fig.15 PRIOR ART
Figure 16:
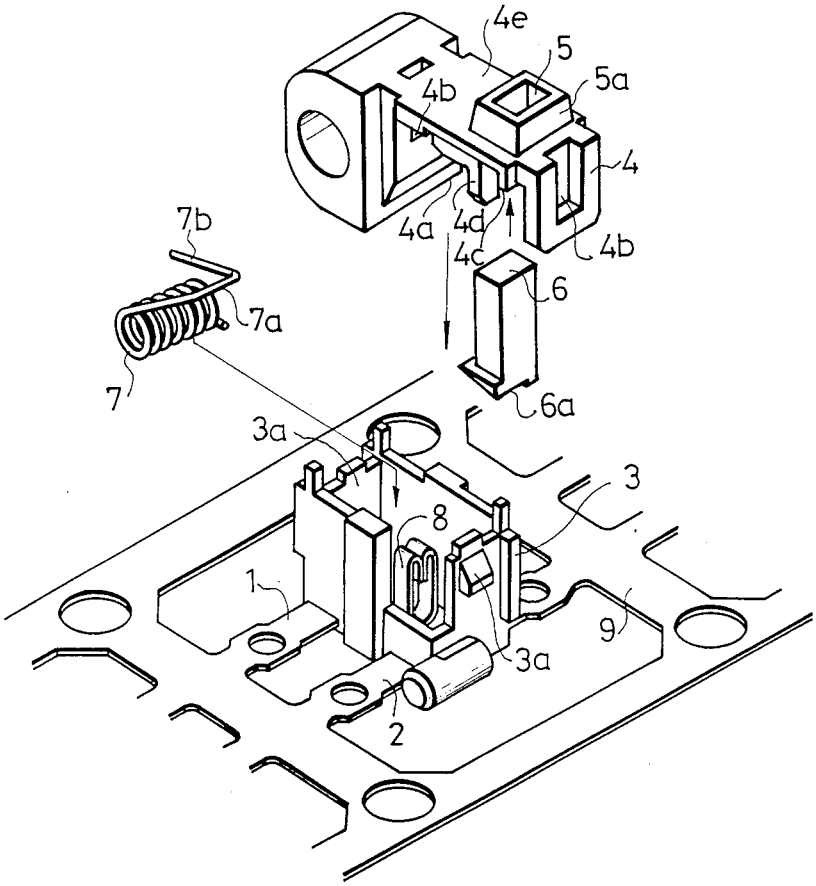
Fig.16 PRIOR ART

After the case 4 is separated from a mold as shown in FIG. 7, the runners 11-11 are cut by pushing the slide 6 in the E direction as in the first embodiment, and the case 4 including the slide 6 therein is mounted on the wafer 3. The base board is separated from the hoop, and the lever 15 is bent back on the case 4, oscillably engaging the engage projection 14 of the case 4. Thus the switch assembly is finished. In FIGS. 9, 10 and 11, projections 16 and 17 extending from the wafer 3 are used for fixing the position of the wafer 3. As to the other members or parts equal or equivalent to those of the prior art or the first embodiment, redundant explanation is omitted here.

The second embodiment enables a further reduction of the manufacturing cost and the cost of parts because the lever 15 which can push the slide 6 is added to the case 4 and is formed in a single body together with the slide 6. Additionally, the lever 15 serves to determine the position of the slide 6 in the sliding direction.

As described, according to the invention wherein the slide and case are molded in a single body and thereafter separated by cutting the runners uniting the slide to the case just before the case is mounted on the wafer, the single body formation of the slide and case reduces the number and the manufacturing cost of the parts. Beside this, since the slide is held in the guide hole while the case is mounted on the wafer, the assembling of the switch assembly is facilitated, and the assembling cost is reduced.

Further, since the surfaces opposed to runner projections extending from the slide and guide hole are provided with relief slits offset from the original plane of the surface a malfunction of the switch assembly which may caused by the runner projections hitting or dragging against the opposed surfaces never occurs regardless of irregular lengths of the runner projections.

The embodiments of the invention in which an exclusive property or privilege is claimed are defined as follows:

1. In a switch assembly including a lower housing having an opening on an upper side thereof and a cavity defined therein for mounting a pair of switch contacts, one of said switch contacts having a movable contact portion which is spring-biased so as to be reciprocable in up and down directions, an upper housing mountable over the opening of said lower housing to enclose said cavity and having a guide portion with a guide hole for guiding a slide positioned therein for reciprocating sliding movement in the up and down directions, said upper housing being assembled to said lower housing such that a lower end of said slide is pressed against said movable contact portion and an upper end of said slide projects externally of said upper housing for actuating said switch assembly, the improvement wherein said upper housing and said slide are originally formed in a single body with said slide positioned in said guide hole and at least one runner portion attached between a side wall of the slide and an inner wall of said guide hole, said slide being separated from said upper housing during assembly by cutting said runner portion, wherein any cut ends remaining attached to said side wall of said slide and to said inner wall of said guide hole form respective runner projections, said side wall of said slide being formed with a relief slit recessed from the plane of the side wall so as to avoid or alleviate jamming contact with the runner projection attached to said inner wall of said guide hole, and said inner wall of said guide hole being formed with a relief slit recessed from the plane of the inner wall so as to avoid or alleviate jamming contact with the runner projection attached to said side wall of said slide during reciprocating sliding movement of said slide in said guide hole.

2. A switch assembly of claim 1 further comprising a lever formed integrally with said upper housing via a hinge, said lever being provided therein with a recess engageable with the upper end of said slide during assembly of said upper housing to said lower housing, wherein said upper end of said slide projects from the upper housing and is engaged in said recess in said lever, whereby said switch assembly can be actuated and said slide can be reciprocated by depressing said lever.

3. A switch assembly of claim 2 wherein said lever is further formed with a through hole communicating with said recess for facilitating molding and assembly.

4. A switch assembly of claim 2 wherein said lever has at both lateral surfaces thereof depressions engageable with stop projections formed on the upper housing when said lever is depressed.

* * * * *